US011193077B1

(12) United States Patent
Ellery

(10) Patent No.: US 11,193,077 B1
(45) Date of Patent: Dec. 7, 2021

(54) GASOLINE FOR AIRCRAFT USE

(71) Applicant: Airworthy AutoGas, LLC, Phoenix, AZ (US)

(72) Inventor: Mark Vincent Ellery, Scottsdale, AZ (US)

(73) Assignee: AIRWORTHY AUTOGAS, LLC, Phoenix, AZ (US)

( * ) Notice: Subject to any disclaimer, the term of this patent is extended or adjusted under 35 U.S.C. 154(b) by 484 days.

(21) Appl. No.: 13/800,809

(22) Filed: Mar. 13, 2013

(51) Int. Cl.
*C10L 10/10* (2006.01)
*C10L 1/182* (2006.01)
*C10L 10/00* (2006.01)

(52) U.S. Cl.
CPC ..... *C10L 10/10* (2013.01); *C10L 1/1824* (2013.01); *C10L 10/00* (2013.01)

(58) Field of Classification Search
CPC ..... C10L 1/1824; C10L 10/00; C10L 10/10
USPC ..... 44/451
See application file for complete search history.

(56) References Cited

U.S. PATENT DOCUMENTS

| | | | | |
|---|---|---|---|---|
| 5,288,393 | A | 2/1994 | Jessup | |
| 5,470,358 | A | 11/1995 | Gaughan | |
| 6,132,479 | A | 10/2000 | Welstand | |
| 6,258,987 | B1 * | 7/2001 | Schmidt | C10L 1/023 208/16 |
| 6,419,716 | B2 | 7/2002 | Scott | |
| 6,767,372 | B2 | 7/2004 | Barnes | |
| 6,858,048 | B1 * | 2/2005 | Jimeson | C10L 1/1822 44/452 |
| 7,462,207 | B2 | 12/2008 | Clark | |
| 7,541,502 | B2 | 6/2009 | Ketley | |
| 7,553,404 | B2 | 6/2009 | Clark | |
| 7,833,295 | B2 | 11/2010 | Clark | |
| 7,897,034 | B2 | 3/2011 | Oliveira | |
| 7,981,170 | B1 * | 7/2011 | Lieder | C10L 1/023 44/451 |
| 8,232,437 | B2 | 7/2012 | Clark | |
| 8,741,126 | B2 * | 6/2014 | Demoment | C10L 1/06 208/16 |
| 2002/0014035 | A1 | 2/2002 | Scott | |
| 2002/0045785 | A1 | 4/2002 | Bazzani | |
| 2002/0068842 | A1 | 6/2002 | Brundage | |
| 2003/0040650 | A1 | 2/2003 | Butler | |
| 2005/0229479 | A1 | 10/2005 | Fernandes | |
| 2008/0134571 | A1 * | 6/2008 | Landschof | C10L 1/023 44/424 |
| 2009/0199464 | A1 | 8/2009 | Wolf | |
| 2010/0131247 | A1 * | 5/2010 | Carpenter | C10L 1/023 703/2 |
| 2011/0114536 | A1 | 5/2011 | Demoment | |
| 2011/0220053 | A1 * | 9/2011 | Croft | C10L 1/1608 123/1 A |

FOREIGN PATENT DOCUMENTS

| | | |
|---|---|---|
| EP | 0466511 | 1/1992 |
| EP | 0948584 | 10/1999 |
| EP | 1068282 | 1/2001 |
| EP | 1359207 | 11/2003 |
| WO | WO/1998/022556 | 5/1998 |
| WO | WO/1999/049003 | 9/1999 |

OTHER PUBLICATIONS

ASTM D910 Standard Specification for Aviation Gasolines (2 pages).
ASTM D4814 Standard Specification for Automotive Fuel (3 pages).
ASTM D6227 Standard Specification for Unleaded Aviation Gasoline (3 pages).
ASTM D7547 Standard Specification for Unleaded Aviation Gasoline (2 pages).
FAA's Unleaded AVGAS Transition Aviation Rulemaking Committee. FAA UAT ARC Final Report Part One. Feb. 17, 2012 (99 pages).
FAA's Unleaded AVGAS Transition Aviation Rulemaking Committee. FAA UAT ARC Final Report Part Two. Feb. 17, 2012 (162 pages).
Gaffney JS, et al. The impacts of combustion emissions on air quality and climate—From coal to biofuels and beyond. Atmospheric Environment, 43 (2009), 23-36.
Lycoming Service Instruction (SI) 1070. Apr. 16, 2012 (10 pages).
Australian Flying Staff, "Piper Aircraft Tests Autogas Archer" (2013) http://www.australianflying.com.au/news/piper-aircraft-tests-autogas-archer (3 pages).
General Aviation News Staff, "Archer flown on autogas makes its way to Oshkosh" (2013) http://generalaviationnews.com/2013/07/23/archer-flown-on-autogas-makes-its-way-to-oshkosh/(4 pages).

(Continued)

*Primary Examiner* — Latosha Hines
(74) *Attorney, Agent, or Firm* — Ballard Spahr LLP

(57) ABSTRACT

Disclosed herein is a method for preparing a blended gasoline composition comprising: a) providing an automotive gasoline; and b) blending the automotive gasoline with an octane enhancer and with a pressurant, thereby making the blended gasoline composition; wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition; wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended fuel composition. Also disclosed herein is the blended gasoline composition.

13 Claims, No Drawings

(56) References Cited

OTHER PUBLICATIONS

McCoy, D., "Piper flies an aircraft with automotive gas" (2013) http://www.bizjournals.com/wichita/news/2013/07/08/piper-flies-an-aircraft-with.html (2 pages).

Morris J., "Alternative AutoGas' Lead-Free Fuel May Offer a Solution" (2013) http://aviationweek.com/blog/alternative-autogas-lead-free-fuel-may-offer-solution (2 pages).

Pew, G. "Airworthy Autogas For General Aviation?" (2013) http://www.avweb.com/avwebflash/news/unleaded_aviation_fuel_octane_100ll_replacement_208740-1.html (4 pages).

Piper, "Piper Completes Flight Tests of Archer Fueled by Airworthy Auto Gas" (2013) http://www.piper.com/piper-completes-flight-tests-archer-fueled-airworthy-auto-gas/ (1 page).

Pope, S., "Piper Aircraft Evaluating Unleaded Auto Gasoline—Airworthy AutoGas fuel put to test in Archer." (2013) http://www.flyingmag.com/news/piper-aircraft-evaluating-unleaded-auto-gasoline (2 pages).

Ruley, J., "AvGas vs. AutoGas", (2004) http://www.avweb.com/news/maint/187232-1.html (6 pages).

Szymanski, John," Octane 101: Autogas vs. avgas" (2002) http://www.aviationpros.com/article/10387611/octane-101-autogas-vs-avgas (1 page).

Wilson, B., "Phoenix company plans to offer aviation autogas" (2013) https://www.aopa.org/news-and-media/all-news/2013/May/23/phoenix-company-plans-to-offer-aviation-autogas (3 pages).

Wood, J. "Airworthy AutoGas prepares for takeoff" (2013) http://generalaviationnews.com/2013/09/12/airworthy-autogas-prepares-for-takeoff/ (2015).

Wood, J. "New study shows autogas can power 80% of piston aircraft" (2012) http://generalaviationnews.com/2012/07/12/new-study-shows-autogas-can-power-80-of-piston-aircraft/ (9 pages).

* cited by examiner

GASOLINE FOR AIRCRAFT USE

BACKGROUND

Over the past century, General Aviation (GA), which includes all flying except for military and scheduled airline operations, has become a significant and integral part of the U.S. economy creating millions of jobs and making a positive impact on the U.S. balance of trade. The United States continues to be one of the world leaders in the design, manufacture, and use of GA airframes, engines, avionics, and supporting technologies. GA is a key catalyst for economic growth and has a profound influence on the quality of life in the United States. GA today touches nearly every aspect of our daily lives, and its continued success will shape American society and the American economy over the next century. Often, GA is thought of as recreational aviation, but there are many commercial and governmental operations that fall within this category of flying.

Consequently, aviation gasoline (AVGAS), which is a vital element in the operation of aircraft, which are powered by piston-driven engine, is vital within GA. There are approximately 167,000 aircraft in the United States GA fleet, the vast majority of which rely upon, and are currently fueled with 100 low lead (100LL) AVGAS, which is the only readily available gasoline for these aircraft.

Unfortunately, the 100LL AVGAS of today contains the additive tetraethyl lead (TEL), which has been used as an aviation gasoline additive for decades in order to meet the very high octane levels required to prevent detonation (engine knock) in high compression and high performance aircraft engines, and to satisfy the valve train lubricity needs of these engines.

It must be understood however, that of all the aircraft in the US and world-wide fleet of GA, as many as 80 percent are not powered by high compression or high performance engines; rather, they are powered by lower compression and lower performance engines, and which consequently could be fueled with lower performance aviation gasoline, if such a fuel was made readily available. That is, if a suitable lesser performance aviation gasoline was introduced into the marketplace, 80 percent of the GA fleet could operate on it; whereas, the balance of the fleet (20 percent of the aircraft) would continue to operate on the 100LL AVGAS (or an Unleaded replacement for 100LL AVGAS). Complicating matters, there are serious problems with 100LL AVGAS. Petitions and potential litigation from environmental organizations regarding lead-containing 100LL AVGAS, citing the adverse health impacts to humans and the environment from exposure to lead, have called for the US Environmental Protection Agency (EPA) to consider regulatory actions to eliminate or reduce lead emissions from aircraft. Similar regulatory actions are under consideration globally.

These activities raise concerns about the continued availability and use of leaded 100LL AVGAS. With the current number of aircraft that are powered by piston-driven engines in the US alone, which is more than 200 times larger than annual new aircraft production, the turnover rate of the existing fleet is very low. This low turnover rate leaves existing aircraft owners particularly vulnerable to devaluation of their aircraft should an unleaded replacement AVGAS be incompatible with the existing fleet. This vulnerability, combined with the stagnation of new aircraft sales and an overall deteriorating economic condition within the aviation industry, has created a sense of urgency regarding the development and deployment of an unleaded replacement for 100LL AVGAS. However, while efforts are under way towards developing an unleaded 100LL AVGAS replacement, these efforts are focusing on a replacement AVGAS that meets the performance demands of the entire GA fleet, not simply the 20 percent that actually needs it. As mentioned above, 80 percent of the GA fleet does not need 100LL AVGAS or an unleaded replacement for 100LL AVGAS to operate safely and efficiently.

Regardless, in response to the rapidly increasing concerns expressed by the GA community, the Unleaded AVGAS Transition Aviation Rulemaking Committee (UAT ARC) was chartered on Jan. 31, 2011, by the Federal Aviation Administration (FAA) Administrator to investigate, prioritize, and summarize the current issues relating to the transition to an unleaded replacement for 100LL AVGAS; and to recommend the tasks necessary to investigate and resolve these issues. The UAT ARC confirmed that an unleaded replacement fuel that meets the needs of the entire fleet does not currently exist.

As such, there remains a need for an inexpensive, suitable, and unleaded aviation fuel to relieve the pressures involved with transitioning GA towards the elimination of lead in aviation fuel.

SUMMARY

In accordance with the purposes of the invention, as embodied and broadly described herein, the invention, in one aspect, relates to a method for preparing a blended gasoline composition comprising:

a) providing an automotive gasoline; and b) blending the automotive gasoline with an octane enhancer and with a pressurant, thereby making the blended gasoline composition;

wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition;

wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended gasoline composition.

In accordance with the purpose of the invention, as embodied and broadly described herein, the invention, in another aspect, a blended gasoline composition comprising:

a) an automotive gasoline in an amount that ranges from 40% by volume to 97% by volume, based on the total volume of the blended gasoline composition;

b) an octane enhancer in an amount that ranges from 2% by volume to 59% by volume, based on the total volume of the blended gasoline composition; and c) a pressurant in an amount that ranges from 1% by volume to 10% by volume, based on the total volume of the blended gasoline composition;

wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition;

wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended fuel composition In another aspect, the invention relates to a method for using a blended gasoline composition in an engine aircraft comprising combusting the blended gasoline composition in an aircraft that is powered by a piston-driven engine.

DESCRIPTION

The present invention can be understood more readily by reference to the following detailed description of the invention and the Examples included therein.

Before the present compounds, compositions, articles, systems, devices, and/or methods are disclosed and described, it is to be understood that they are not limited to specific synthetic methods unless otherwise specified, or to particular reagents unless otherwise specified, as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

While aspects of the present invention can be described and claimed in a particular statutory class, such as the method of use statutory class, this is for convenience only and one of skill in the art will understand that each aspect of the present invention can be described and claimed in any statutory class.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

A. Definitions

As used herein, nomenclature for compounds, including organic compounds, can be given using common names, IUPAC, IUBMB, or CAS recommendations for nomenclature. When one or more stereochemical features are present, Cahn-Ingold-Prelog rules for stereochemistry can be employed to designate stereochemical priority, E/Z specification, and the like. One of skill in the art can readily ascertain the structure of a compound if given a name, either by systemic reduction of the compound structure using naming conventions, or by commercially available software, such as CHEMDRAW™ (Cambridgesoft Corporation, U.S.A.).

As used in the specification and the appended claims, the singular forms "a," "an" and "the" include plural referents unless the context clearly dictates otherwise. Thus, for example, reference to "a functional group," "an alkyl," or "a residue" includes mixtures of two or more such functional groups, alkyls, or residues, and the like.

Ranges can be expressed herein as from "about" one particular value, and/or to "about" another particular value. When such a range is expressed, a further aspect includes from the one particular value and/or to the other particular value. Similarly, when values are expressed as approximations, by use of the antecedent "about," it will be understood that the particular value forms a further aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

References in the specification and concluding claims to parts by weight of a particular element or in a composition denotes the weight relationship between the element or any other elements or in the composition or article for which a part by weight is expressed. Thus, in a compound containing 2 parts by weight of X and 5 parts by weight Y, X and Y are present at a weight ratio of 2:5, and are present in such ratio regardless of whether additional elements are contained in the compound.

A weight percent (wt. %) of a component of a composition, unless specifically stated to the contrary, is based on the total weight of the formulation or composition in which the component is included.

A volume percent (vol. %) of a component of a composition, unless specifically stated to the contrary, is based on the total volume of the formulation or composition in which the component is included.

As used herein, the term "oxygenate" means any compound that comprises both carbon and oxygen.

As used herein, the terms "optional" or "optionally" means that the subsequently described event or circumstance can or cannot occur, and that the description includes instances where said event or circumstance occurs and instances where it does not.

As used herein, the term "derivative" refers to a compound having a structure derived from the structure of a parent compound (e.g., a compound disclosed herein) and whose structure is sufficiently similar to those disclosed herein and based upon that similarity, would be expected by one skilled in the art to exhibit the same or similar activities and utilities as the claimed compounds, or to induce, as a precursor, the same or similar activities and utilities as the claimed compounds. Exemplary derivatives include salts, esters, amides, salts of esters or amides, and N-oxides of a parent compound.

As used herein, the term "substituted" is contemplated to include all permissible substituents of organic compounds. In a broad aspect, the permissible substituents include acyclic and cyclic, branched and unbranched, carbocyclic and heterocyclic, and aromatic and nonaromatic substituents of organic compounds. Illustrative substituents include, for example, those described below. The permissible substituents can be one or more and the same or different for appropriate organic compounds. For purposes of this disclosure, the heteroatoms, such as nitrogen, can have hydrogen substituents and/or any permissible substituents of organic compounds described herein which satisfy the valences of the heteroatoms. This disclosure is not intended to be limited in any manner by the permissible substituents of organic compounds. Also, the terms "substitution" or "substituted with" include the implicit proviso that such substitution is in accordance with permitted valence of the substituted atom and the substituent, and that the substitution results in a stable compound, e.g., a compound that does not spontaneously undergo transformation such as by rearrangement, cyclization, elimination, etc. It is also contemplated that, in certain aspects, unless expressly indicated to the contrary, individual substituents can be further optionally substituted (i.e., further substituted or unsubstituted).

In defining various terms, "$A^1$," "$A^2$," "$A^3$," and "$A^4$" are used herein as generic symbols to represent various specific substituents. These symbols can be any substituent, not limited to those disclosed herein, and when they are defined to be certain substituents in one instance, they can, in another instance, be defined as some other substituents.

The term "aliphatic" or "aliphatic group," as used herein, denotes a hydrocarbon moiety that may be straight-chain (i.e., unbranched), branched, or cyclic (including fused, bridging, and spirofused polycyclic) and may be completely saturated or may contain one or more units of unsaturation, but which is not aromatic. Unless otherwise specified, aliphatic groups contain 1-20 carbon atoms. Aliphatic groups include, but are not limited to, linear or branched, alkyl, alkenyl, and alkynyl groups, and hybrids thereof such as (cycloalkyl)alkyl, (cycloalkenyl)alkyl or (cycloalkyl)alkenyl.

The term "alkyl" as used herein is a branched or unbranched saturated hydrocarbon group of 1 to 24 carbon atoms, such as methyl, ethyl, n-propyl, isopropyl, n-butyl, isobutyl, s-butyl, t-butyl, n-pentyl, isopentyl, s-pentyl, neopentyl, hexyl, heptyl, octyl, nonyl, decyl, dodecyl, tetradecyl, hexadecyl, eicosyl, tetracosyl, and the like. It is understood that the alkyl group is acyclic. The alkyl group can be branched or unbranched. The alkyl group can also be substituted or unsubstituted. For example, the alkyl group can be substituted with one or more groups including, but not limited to, alkyl, cycloalkyl, alkoxy, amino, ether, halide, hydroxy, nitro, silyl, sulfo-oxo, or thiol, as described herein. A "lower alkyl" group is an alkyl group containing from one to six (e.g., from one to four) carbon atoms. The term alkyl group can also be a C1 alkyl, C1-C2 alkyl, C1-C3 alkyl, C1-C4 alkyl, C1-C5 alkyl, C1-C6 alkyl, C1-C7 alkyl, C1-C8 alkyl, C1-C9 alkyl, C1-C10 alkyl, C1-C12 alkyl and the like up to and including a C1-C24 alkyl.

Throughout the specification "alkyl" is generally used to refer to both unsubstituted alkyl groups and substituted alkyl groups; however, substituted alkyl groups are also specifically referred to herein by identifying the specific substituent(s) on the alkyl group. For example, the term "halogenated alkyl" or "haloalkyl" specifically refers to an alkyl group that is substituted with one or more halide, e.g., fluorine, chlorine, bromine, or iodine. Alternatively, the term "monohaloalkyl" specifically refers to an alkyl group that is substituted with a single halide, e.g. fluorine, chlorine, bromine, or iodine. The term "polyhaloalkyl" specifically refers to an alkyl group that is independently substituted with two or more halides, i.e. each halide substituent need not be the same halide as another halide substituent, nor do the multiple instances of a halide substituent need to be on the same carbon. The term "alkoxyalkyl" specifically refers to an alkyl group that is substituted with one or more alkoxy groups, as described below. The term "aminoalkyl" specifically refers to an alkyl group that is substituted with one or more amino groups. The term "hydroxyalkyl" specifically refers to an alkyl group that is substituted with one or more hydroxy groups. When "alkyl" is used in one instance and a specific term such as "hydroxyalkyl" is used in another, it is not meant to imply that the term "alkyl" does not also refer to specific terms such as "hydroxyalkyl" and the like.

The term "aromatic compound" as used herein refers to a compound comprising a ring structure having cyclic clouds of delocalized π electrons above and below the plane of the molecule, where the πclouds contain (4n+2) π electrons. A further discussion of aromaticity is found in Morrison and Boyd, Organic Chemistry, (5th Ed., 1987), Chapter 13, entitled "Aromaticity," pages 477-497, incorporated herein by reference. The term "aromatic compound" is inclusive of both aryl and heteroaryl groups.

The term "heteroaryl," as used herein refers to an aromatic group that has at least one heteroatom incorporated within the ring of the aromatic group. Examples of heteroatoms include, but are not limited to, nitrogen, oxygen, sulfur, and phosphorus, where N-oxides, sulfur oxides, and dioxides are permissible heteroatom substitutions. The heteroaryl group can be substituted or unsubstituted. The heteroaryl group can be substituted with one or more groups including, but not limited to, alkyl, cycloalkyl, alkoxy, amino, ether, halide, hydroxy, nitro, silyl, sulfo-oxo, or thiol as described herein. Heteroaryl groups can be monocyclic, or alternatively fused ring systems. Heteroaryl groups include, but are not limited to, furyl, imidazolyl, pyrimidinyl, tetrazolyl, thienyl, pyridinyl, pyrrolyl, N-methylpyrrolyl, quinolinyl, isoquinolinyl, pyrazolyl, triazolyl, thiazolyl, oxazolyl, isoxazolyl, oxadiazolyl, thiadiazolyl, isothiazolyl, pyridazinyl, pyrazinyl, benzofuranyl, benzodioxolyl, benzothiophenyl, indolyl, indazolyl, benzimidazolyl, imidazopyridinyl, pyrazolopyridinyl, and pyrazolopyrimidinyl. Further not limiting examples of heteroaryl groups include, but are not limited to, pyridinyl, pyridazinyl, pyrimidinyl, pyrazinyl, thiophenyl, pyrazolyl, imidazolyl, benzo[d]oxazolyl, benzo[d]thiazolyl, quinolinyl, quinazolinyl, indazolyl, imidazo[1,2-b]pyridazinyl, imidazo[1,2-a]pyrazinyl, benzo[c][1,2,5]thiadiazolyl, benzo[c][1,2,5]oxadiazolyl, and pyrido[2,3-b]pyrazinyl.

The term "carboxylic acid" as used herein is represented by the formula —C(O)OH.

The term "ester" as used herein is represented by the formula —OC(O)$A^1$ or —C(O)O$A^1$, where $A^1$ can be alkyl, cycloalkyl, alkenyl, cycloalkenyl, alkynyl, cycloalkynyl, aryl, or heteroaryl group as described herein. The term "polyester" as used herein is represented by the formula -($A^1$O(O)C-$A^2$-C(O)O)$_a$— or -($A^1$O(O)C-$A^2$-OC(N$_a$—, where $A^1$ and $A^2$ can be, independently, an alkyl, cycloalkyl, alkenyl, cycloalkenyl, alkynyl, cycloalkynyl, aryl, or heteroaryl group described herein and "a" is an integer from 1 to 500. "Polyester" is as the term used to describe a group that is produced by the reaction between a compound having at least two carboxylic acid groups with a compound having at least two hydroxyl groups.

The term "ether" as used herein is represented by the formula $A^1$O$A^2$, where $A^1$ and $A^2$ can be, independently, an alkyl, cycloalkyl, alkenyl, cycloalkenyl, alkynyl, cycloalkynyl, aryl, or heteroaryl group described herein. The term "polyether" as used herein is represented by the formula -($A^1$O-$A^2$O)$_n$—, where $A^1$ and $A^2$ can be, independently, an alkyl, cycloalkyl, alkenyl, cycloalkenyl, alkynyl, cycloalkynyl, aryl, or heteroaryl group described herein and "a" is an integer of from 1 to 500. Examples of polyether groups include polyethylene oxide, polypropylene oxide, and polybutylene oxide.

Certain materials, compounds, compositions, and components disclosed herein can be obtained commercially or readily synthesized using techniques generally known to those of skill in the art. For example, the starting materials and reagents used in preparing the disclosed compounds and compositions are either available from commercial suppliers such as Aldrich Chemical Co., (Milwaukee, Wis.), Acros Organics (Morris Plains, N.J.), Fisher Scientific (Pittsburgh, Pa.), or Sigma (St. Louis, Mo.) or are prepared by methods known to those skilled in the art following procedures set forth in references such as Fieser and Fieser's Reagents for Organic Synthesis, Volumes 1-17 (John Wiley and Sons, 1991); Rodd's Chemistry of Carbon Compounds, Volumes 1-5 and Supplementals (Elsevier Science Publishers, 1989); Organic Reactions, Volumes 1-40 (John Wiley and Sons, 1991); March's Advanced Organic Chemistry, (John Wiley and Sons, 4th Edition); and Larock's Comprehensive Organic Transformations (VCH Publishers Inc., 1989).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

Disclosed are the formulations to be used to prepare the compositions of the invention as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these compounds cannot be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the compositions of the invention. Thus, if there are a variety of additional steps that can be performed it is understood that each of these additional steps can be performed with any specific embodiment or combination of embodiments of the methods of the invention.

It is understood that the compositions disclosed herein have certain functions. Disclosed herein are certain structural requirements for performing the disclosed functions, and it is understood that there are a variety of structures that can perform the same function that are related to the disclosed structures, and that these structures will typically achieve the same result.

It is contemplated that each disclosed derivative can be optionally further substituted. It is also contemplated that any one or more derivative can be optionally omitted from the invention. It is understood that a disclosed compound can be provided by the disclosed methods. It is also understood that the disclosed compounds can be employed in the disclosed methods of using.

B. Compositions

In one aspect, the blended gasoline comprises an automotive gasoline, an octane enhancer, and a pressurant. As used herein, the blended gasoline or the blended gasoline composition should be distinguished from the automotive gasoline. The automotive gasoline is a component of the blended gasoline or blended gasoline composition. In one further aspect, the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition and an oxygen content, contributed by methanol, in an amount that ranges from 0% by weight to 0.1% by weight, based on the total weight of the blended gasoline composition and the total oxygen content weight contribution of methanol present in the blended gasoline composition. In another further aspect, the blended gasoline composition further comprises lead in an amount that ranges from 0 grams per gallon to 0.05 grams per gallon of the blended gasoline composition.

In another aspect, the blended gasoline comprises an automotive gasoline in an amount that ranges from 40% by volume to 97% by volume, based on the total volume of the blended gasoline composition; an octane enhancer in an amount that ranges from 2% by volume to 59% by volume, based on the total volume of the blended gasoline composition; and a pressurant in an amount that ranges from 1% by volume to 10% by volume, based on the total volume of the blended gasoline composition. In a further aspect, the blended gasoline composition comprises an automotive gasoline in an amount that ranges from 55% by volume to 70% by volume, based on the total volume of the blended gasoline composition; an octane enhancer in an amount that ranges from 27% by volume to 55% by volume; and a pressurant in an amount that ranges from 3% by volume to 10% by volume, based on the total volume of the blended gasoline composition.

1. Automotive Gasoline

Automotive gasoline is a term of art and intends any gasoline suitable for use in a motor vehicle. With the particular blending of the invention, such automotive gasoline can be used as a fuel in an aircraft that is powered by a piston-driven engine. In one aspect, the automotive gasoline comprises: a) meeting the requirements of ASTM D4814, or is intended to meet the requirements of the ASTM D4814 specification after the addition of an oxygenate; b) having an anti-knock index value (R+M/2) (AKI) greater than or equal to 84; and c) having a dry vapor pressure equivalent (DVPE) less than or equal to 11.0 pounds per square inch (psi). In another aspect, the automotive gasoline comprises: a) having an anti-knock index value (R+M/2) ranges from 84 to 92 and b) dry vapor pressure equivalent (DVPE) ranges from 5.5 pounds per square inch (psi) to 11.0 pounds per square inch (psi).

In one aspect, the automotive gasoline comprises any automotive gasoline with an anti-knock index (R+M/2) (AKI) ranging from 84 to 92. The AKI varies based on, for example, using regular or premium blendstock for oxygenate blending (BOB) or full octane regular or premium automotive gasoline. In further aspects, the AKI ranges from 84 to 92, including exemplary values of 85, 86, 87, 88, 89, 90, or 91. In still further aspects, the AKI can be in a range derived from any two of the above listed exemplary AKI values. For example, the automotive gasoline can comprise any automotive gasoline with an AKI ranging from 87 to 92. In another aspect, the automotive gasoline can comprise any automotive gasoline with an AKI greater than or equal to 88.

In one aspect, the automotive gasoline has a year-round DVPE less than 11.0 psi. In another aspect, the automotive gasoline has a year-round DVPE exhibited in a range from 5.5 psi to 11.0 psi, including exemplary values, 5.6 psi, 5.7 psi, 5.8 psi, 5.9 psi, 6.0 psi, 6.1 psi, 6.2 psi, 6.3 psi, 6.4 psi, 6.5 psi, 6.6 psi, 6.7 psi, 6.8 psi, 6.9 psi, 7.0 psi, 7.1 psi, 7.2 psi, 7.3 psi, 7.5 psi, 7.7 psi, 8.0 psi, 8.3 psi, 8.5 psi, 8.6 psi, 8.7 psi, 8.8 psi, 8.9 psi, 9.0 psi, 9.2 psi, 9.4 psi, 9.6 psi, 9.8 psi, 10.0 psi, 10.2 psi, 10.4 psi, 10.5 psi, 10.6 psi, 10.8 psi, and 10.9 psi. In still further aspects, the automotive gasoline can exhibit a year-round DVPE in any range of values derived from the above DVPE values. For example, the DVPE can range from 5.5 psi to 10.5 psi or from 7.0 psi to 10.5 psi.

In one aspect, the automotive gasoline comprises a federal reformulated gasoline (RFG), a premium sub-grade BOB, a premium sub-grade Arizona reformulated blendstock for oxygenate blending (AZRBOB), a full octane Arizona Cleaner Burning Gasoline, a premium sub-grade California reformulated blendstock for oxygenate blending (CARBOB), or a full octane California Air Resources Board (CARB). In a further aspect, the automotive gasoline comprises a blendstock for oxygenate blending (BOB). In an even further aspect, the automotive gasoline comprises a cleaner burning gasoline or a conventional gasoline. The automotive gasoline can be formulated at refineries.

In one aspect, the automotive gasoline comprises a federal reformulated gasoline (RFG). The RFG can be regulated by the EPA, who defines the formulation ingredients. The full octane California Air Resources Board (CARB) is an alternative formulation defined by the California Air Resources Board. This formulation can have an aromatic hydrocarbon content that exceeds the 10% volume limit.

In one aspect, the automotive gasoline comprises a conventional gasoline. As used herein, a conventional gasoline refers to a finished automotive gasoline that may or may not contain an oxygenate. Some states have defined their conventional gasoline by statute, for example, Arizona and Nevada have defined their conventional gasoline by statute.

In one aspect, the automotive gasoline comprises a cleaner burning gasoline. As used herein, a cleaner burning gasoline refers to an automotive gasoline which meets the cleaner burning gasoline regulations of a particular state. For example, Arizona and Nevada define their cleaner burning gasoline formulation by statute.

In another aspect, the automotive gasoline comprises a blendstock for oxygenate blending (BOB). A BOB is an unfinished gasoline blendstock, that becomes a blend upon blending with a specified oxygenate at a specific percentage for use in automobiles. A BOB is typically formulated at a refinery which supplies gasoline for use in the United States wherein state and federal regulations relating to ambient air quality standards have resulted in the need for a specifically formulated BOB which is to be blended with a specific oxygenate, at a specific volume percent, so as to result in a blend with such characteristics which, upon combustion, reduce emissions from motor vehicles. This is accomplished within a given fuel formulation by formulating the blend in such a way as to limit levels of specific chemicals, which leads to reduced emissions of total hydrocarbons, and specific volatile organic compounds. During conventional automotive use, the BOB formulation is intended for ethanol blending at the terminal. It is intended herein to use a BOB, but with no or only minimal ethanol addition.

In one aspect, the automotive gasoline comprises a premium BOB. As used herein a premium BOB is the automotive gasoline that will become a final premium gasoline upon the addition of an oxygenate. For automotive use, the conventional oxygenate, ethanol, can be added at 10% by volume based on the total volume of the composition. Adding the oxygenate to the BOB causes the BOB's octane or AKI value to rise by approximately 3.0 numbers in the final blend. Once the oxygenate has been added, the final blend is no longer called a BOB. Therefore, BOB's, having a lower octane value prior to oxygenate blending, are often referred to as "sub-grades." After the ethanol has been added, it may be called a finished blend. It is intended herein to use the premium BOB, but with no or only minimal ethanol addition.

In one aspect, the automotive gasoline is a premium sub-grade Arizona reformulated blendstock for oxygenate blending (AZRBOB). In another aspect, the automotive gasoline is a premium sub-grade California reformulated blendstock for oxygenate blending (CARBOB). Further, both AZRBOB and CARBOB are types of BOBs. Under Arizona law or California law, respectively, the AZRBOB and the CARBOB must be blended with an oxygenate for on-road or automotive use. Typically, Arizona or California law requires that the oxygenate be ethanol, so the automotive gasoline is shipped with the intention of ethanol blending at the terminal. Further, the composition of AZRBOB and CARBOB, and the final blends upon ethanol blending, are defined by statute in their respective states.

Under state law, including Arizona or California, this blending is required by law to achieve established emission standards using the California Predictive Model or the Federal Complex Model. The refiner enters the specific characteristics of the fuel formulation into the appropriate model, the model calculates the expected fuel emissions, and the model determines if the fuel "passes" the model. The characteristics entered into the model include RVP, T50, T90, E200, E300, Sulfur, Aromatics, Olefins, Benzene, and Oxygen. For the fuel to pass, the automotive fuel must be within the maximums or minimums set within of the emissions models. It is intended herein to use the AZRBOB and CARBOB with no or only minimal ethanol addition.

As a non-limiting example, in one aspect, the AZRBOB can comprise aromatics of a max 55% volume, olefins of a max 27.5% volume (measured by ASTM method D-1319), lead of a max 0.030 gm/gal, oxygen content max 0.05% wt, and sulfur max 89 ppm (measured by ASTM method D-2622-94, D-5453-93). In another aspect, the AZRBOB can comprise aromatics of a max 33.1% volume, olefins of a max 11.1% volume, lead of a max 0.030 gm/gal, oxygen content max 0.05% wt, and sulfur max 89 ppm.

As a non-limiting example, in one aspect, CARBOB can comprise sulfur ppm of 21, benzene 1.22% volume max, aromatic 38.7% volume max, olefins 11.1% volume max, MTBE 0.006 wt % max, oxygen content 0.06 wt % max, lead 0.030 gm/gal max, and phosphorus 0.005 gm/gal.

In accordance with the purpose of the invention, in one aspect, the automotive gasoline is not blended with an additional oxygenate. In another aspect, the automotive gasoline can be segregated in storage and not blended with an oxygenate. In another aspect, only non-methanol and non-ethanol oxygenates are blended with the automotive gasoline. Some small amount of methanol and ethanol can be tolerated, but their content should be minimized. The automotive gasoline can be used as the "base," to which the octane enhancer is added, in order to increase the AKI value of the blended gasoline, and to which the pressurant is added, in order to adjust the dry vapor pressure equivalent (DVPE) of the blended gasoline to the desired level.

In yet further aspects, the blended gasoline composition comprises an automotive gasoline in an amount that ranges from 40% by volume to 97% by volume, based on the total volume of the blended gasoline composition, including exemplary values of 41% by volume, 42% by volume, 43% by volume, 44% by volume, 45% by volume, 50% by volume, 55% by volume, 60% by volume, 65% by volume, 70% by volume, 71% by volume, 72% by volume, 73% by volume, 74% by volume 75% by volume, 76% by volume, 77% by volume, 78% by volume, 79% by volume, 80% by volume, 85% by volume, 90% by volume, and 95% by volume. In still further aspects, the blended gasoline composition comprises an automotive gasoline in a range derived from any two of the above listed exemplary automotive gasoline volume percentage values. For example, the blended gasoline composition can comprise an automotive gasoline in an amount that ranges from 41% by volume to 75% by volume, based on the total volume of the blended gasoline composition. In another aspect, the blended gasoline composition comprises an automotive gasoline in an amount that ranges from 56% by volume to 75% by volume, based on the total volume of the blended gasoline composition. In a further aspect, the blended gasoline composition comprises an automotive gasoline in an amount that ranges from 60% by volume to 75% by volume, based on the total volume of the blended gasoline composition.

The automotive gasoline typically comprises an aromatic compound. The term "aromatic compound" as used herein refers to a compound comprising a ring structure having cyclic clouds of delocalized $\pi$ electrons above and below the plane of the molecule, where the $\pi$ clouds contain $(4n+2)$ $\pi$ electrons. A further discussion of aromaticity is found in Morrison and Boyd, Organic Chemistry, (5th Ed., 1987), Chapter 13, entitled "Aromaticity," pages 477-497, incorporated herein by reference for its teaching of aromaticity. The term "aromatic compound" is inclusive of both aryl and heteroaryl groups. An aromatic compound includes, but is not limited to, benzene, naphthalene, phenyl, biphenyl, anthracene, and the like. The aromatic compound can be substituted or unsubstituted. The aromatic compound can be substituted with one or more groups including, but not limited to, alkyl, cycloalkyl, alkoxy, alkenyl, cycloalkenyl, alkynyl, cycloalkynyl, aryl, heteroaryl, aldehyde, —$NH_2$, carboxylic acid, ester, ether, halide, hydroxy, ketone, azide, nitro, silyl, sulfo-oxo, or thiol as described herein. The term "biaryl" is a specific type of group in the aromatic compound and is included in the definition of "aromatic compound." In addition, the aromatic compound can be a single ring structure or comprise multiple ring structures that are either fused ring structures or attached via one or more bridging groups such as a carbon-carbon bond. For example, biaryl can be two aryl groups that are bound together via a fused ring structure, as in naphthalene, or are attached via one or more carbon-carbon bonds, as in biphenyl. The automotive gasoline can comprise one or more aromatic compounds.

In one aspect, the aromatic compound comprises benzene, toluene, ethyl benzene, phenol, alkylphenol, alkylbenzene, a brominated substituted aromatic compound, naphthalene, styrene, or xylene, or a combination thereof. In another aspect, the alkyl benzene comprises 1-methyl-2-ethyl benzene, 1-methyl-3-ethyl benzene, ethyl benzene, 1,3,5-trimethylbenzene, 1,2,4-trimethylbenzene, n-butylbenzene, 1,2-diethyl benzene, or 1,2,4,5-tetramethyl benzene, or a combination thereof.

In yet further aspects, the automotive gasoline comprises an aromatic fraction in an amount that ranges from 1% by volume to 60% by volume, based on the total volume of the automotive gasoline, including exemplary values of 2% by volume, 3% by volume, 4% by volume, 5% by volume, 6% by volume, 7% by volume, 8% by volume, 9% by volume, 10% by volume, 11% by volume, 12% by volume, 13% by volume, 14% by volume, 15% by volume, 16% by volume, 17% by volume, 18% by volume, 19% by volume, 20% by volume, 21% by volume, 22% by volume, 23% by volume, 24% by volume, 25% by volume, 26% by volume, 27% by volume, 28% by volume, 29% by volume, 30% by volume, 35% by volume, 40% by volume, 45% by volume, 48% by volume, 49% by volume, 50% by volume, 51% by volume, 52% by volume, 53% by volume, 54% by volume, 55% by volume, 56% by volume, 57% by volume, 58% by volume, and 59% by volume. In still further aspects, the automotive gasoline comprises an aromatic fraction in a range derived from any two of the above listed exemplary aromatic fraction volume percentage values. For example, the automotive gasoline can comprise an aromatic fraction in an amount that ranges from 1% by volume to 50% by volume, based on the total volume of the automotive gasoline or in an amount that ranges from 1% by volume to 45% by volume, based on the total volume of the automotive gasoline. In another aspect, the automotive gasoline can comprise an aromatic fraction in an amount that ranges from 20% by volume to 45% by volume, based on the total volume of the automotive gasoline.

In one aspect, the aromatic fraction in the automotive gasoline comprises an aromatic compound found naturally in the crude oil. In another aspect, the aromatic fraction in the automotive gasoline comprises an aromatic compound found naturally in the automotive gasoline after being processed by the refinery but prior to the addition of an oxygenate. In a further aspect, when the aromatic fraction is naturally occurring, rather than added, the aromatic fraction percent by volume can be determined using high-performance liquid chromatography (HPLC), liquid chromatography/mass spectrometry (LC-MS or LCMS), or any other appropriate form of chromatography or spectroscopy. The aromatic fraction of the automotive gasoline can also be measured by the refiner using any appropriate form of spectroscopy prior to shipment or prior to the addition of an oxygenate.

In a further aspect, the aromatic fraction in the automotive gasoline can be measured using ASTM D-5580.

2. Octane Enhancer

The blended gasoline composition comprises an octane enhancer. An octane enhancer as used herein is a compound or composition that is added to a blended fuel composition to increase the anti-knock index (AKI) value of the blended fuel composition. Increasing the AKI value of the composition contributes towards knock-free engine performance, which is essential to smooth and reliable engine operation.

In one aspect, the octane enhancer comprises an alkylate, a reformate, or an aromatic compound. In another aspect, the octane enhancer comprises toluene. In a further aspect, the octane enhancer consists essentially of toluene. In a yet further aspect, the octane enhancer comprises iso-octane. In an even further aspect, the octane enhancer consists essentially of iso-octane. In one aspect, the octane enhancer is toluene. In another aspect, the octane enhancer is iso-octane.

In one aspect, the alkylate compound comprises a saturated hydrocarbon. In a further aspect, the alkylate compound comprises any of the isomers of hexane, heptane, octane, nonane, or decane. In another aspect, the alkylate compound comprises iso-octane. As used herein, iso-octane can refer to 2-methylhelptane or 2,2,4-trimethylpentane. In a further aspect, the octane enhancer does not comprise 2,2,3-trimethylbutane (also known as triptane) or 2,2,3-trimethylpentane. In an even further aspect, the composition does not comprise 2,2,3-trimethylbutane (also known as triptane) or 2,2,3-trimethylpentane. In one aspect, the composition does not comprise a "super-alkylate" because the composition does not comprise at least 75% by volume isooctane. One skilled in the art would recognize that a composition comprising triptane; 2,2,3-trimethylpentane, and/or a superalkylate would be a more expensive composition than a composition without those components. For this reason, one skilled in the art would typically desire to prepare a composition without triptane; 2,2,3-trimethylpentane, and/or a superalkylate.

In a further aspect, the reformate comprises an aromatic compound or an aliphatic hydrocarbon, or a combination thereof. In a yet further aspect, the reformate comprises benzene, toluene, or xylene, or a combination thereof. In one aspect, the reformate comprises toluene.

In one aspect, the aromatic compound comprises benzene, toluene, or xylene, or a combination thereof.

In another aspect, the aromatic compound comprises toluene. In one aspect, the aromatic compound does not comprise an aromatic amine. In a further aspect, the aromatic compound does not comprise toluidine or a toluidine isomer. In one aspect, the composition does not comprise an aromatic amine. In an even further aspect, the composition does not comprise toluidine or a toluidine isomer. In a yet further aspect, the composition comprises 0% volume to 1% volume of toluidine. In one aspect, the composition has none or a limited amount of toluidine or a toluidine isomer because of toluidine or toluidine isomers are known carcinogens.

In yet further aspects, the blended gasoline composition comprises the octane enhancer in an amount that ranges from 2% by volume to 59% by volume, based on the total volume of the blended gasoline composition, including exemplary values of 3% by volume, 4% by volume, 5% by volume, 6% by volume, 7% by volume, 8% by volume, 9% by volume, 10% by volume, 11% by volume, 12% by volume, 13% by volume, 14% by volume, 15% by volume, 16% by volume, 17% by volume, 18% by volume, 19% by volume, 20% by volume, 21% by volume, 22% by volume, 23% by volume, 24% by volume, 25% by volume, 26% by volume, 27% by volume, 28% by volume, 29% by volume, 30% by volume, 35% by volume, 40% by volume, 45% by volume, 50% by volume, or 55% by volume. In still further aspects, the blended gasoline composition comprises the octane enhancer in an amount in a range derived from any two of the above listed exemplary octane enhancer volume percentage values. For example, the blended gasoline composition can comprise the octane enhancer in an amount that ranges from 1% by volume to 28% by volume, based on the total volume of the blended gasoline composition. In a further aspect, the blended gasoline composition can comprise the octane enhancer in an amount that ranges from 20% by volume to 30% by volume, based on the total volume of the blended gasoline composition.

3. Pressurant

The blended gasoline composition comprises a pressurant. A pressurant, as used herein, is a compound or composition added to a composition to control the DVPE of the blended gasoline composition. In one aspect, the pressurant can be added to modify the DVPE of the blended gasoline composition to an acceptable level.

In one aspect, the pressurant comprises a saturated hydrocarbon chain. In another aspect, the pressurant comprises a linear saturated hydrocarbon. In another aspect, the pressurant comprises an alkyl. In a further aspect, the pressurant comprises any of the isomers of butane, pentane, hexane, heptane, or octane. In an even further aspect, the pressurant comprises butane. In a yet further aspect, the pressurant consists essentially of n-butane. In another aspect, the pressurant comprises n-butane, iso-butane, n-pentane, or isopentane, or a combination thereof. In a further aspect, the pressurant comprises n-butane. In an even further aspect, the pressurant consists essentially of n-butane. In another aspect, the pressurant does not comprise a branched hydrocarbon. In a further aspect, the pressurant does not comprise 2,2,3-trimethylbutane (also known as triptane) or 2,2,3-trimethylpentane. In a yet further aspect, the pressurant comprises a "light end" petroleum based compound, which has a high vapor pressure.

In yet further aspects, the blended gasoline composition comprises the pressurant in an amount that ranges from 1% by volume to 10% by volume, based on the total volume of the blended gasoline composition, including exemplary values of 2% by volume, 3% by volume, 4% by volume, 5% by volume, 6% by volume, 7% by volume, 8% by volume, and 9% by volume. In still further aspects, the blended gasoline composition comprises the pressurant in an amount in a range derived from any two of the above listed exemplary pressurant volume percentage values. For example, the blended gasoline composition can comprise the pressurant in an amount that ranges from 1% by volume to 5% by volume, based on the total volume of the blended gasoline composition. In another aspect, the blended gasoline composition can comprise the pressurant in an amount that ranges from 2% by volume to 7% by volume, based on the total volume of the blended gasoline composition. In a further aspect, the blended gasoline composition can comprise the pressurant in an amount that ranges from 4% by volume to 6% by volume, based on the total volume of the blended gasoline composition.

4. Oxygenate and Oxygen Content

In one aspect, an oxygenate is any compound that comprises both carbon and oxygen. Any oxygenate present in the composition acts as the basis for the oxygen content calculation. The oxygen content for the composition is calculated by determining the weight percentage of the oxygen based on the total weight of the composition (denominator) and based on the total oxygen content weight of all oxygenates present in the composition (numerator). The oxygen content weight of all oxygenates only measures the oxygen weight of the compounds rather than the weight of the entire compounds containing oxygen. The oxygen content for ethanol is calculated based on the oxygen contributed by ethanol, rather than on the total weight of the ethanol compound divided by the total weight of the composition. Similarly, the oxygen content for methanol is calculated based on the oxygen contributed by methanol, rather than on the total weight of the methanol compound, divided by the total weight of the composition.

In one aspect, the oxygenate can be an alcohol, ether, carboxylic acid, or ester, or a combination thereof. In a further aspect, the oxygenate can be an alcohol or an ether. In an even further aspect, the oxygenate can be ethanol. In a yet further aspect, the oxygenate can be methanol, isopropyl alcohol, n-butanol, t-butanol, methyl tert-butyl ether, tertiary amyl methyl ether, tertiary hexyl methyl ether, ethyl tertiary butyl ether, tertiary amyl ethyl ether, or diisopropyl ether, or a combination thereof.

As such, in one aspect, the oxygen content comprises the oxygenate. In a further aspect, the oxygen content comprises ethanol. In an even further aspect, the oxygen content consists essentially of ethanol.

In one aspect, the blended gasoline composition does not comprise an oxygenate. In another aspect, the blended gasoline composition is substantially free of any oxygenates. In one aspect, the blended gasoline composition does not comprise a compound comprising an alcohol, ether, carboxylic acid, or ester. In a further aspect, the blended gasoline composition is substantially free of a compound comprising an alcohol, ether, carboxylic acid, or ester. In an even further aspect, the blended gasoline composition does not comprise a compound comprising an alcohol or an ether. In a yet further aspect, the blended gasoline composition is substantially free of a compound comprising an alcohol or an ether. In one aspect, the blended gasoline composition does not comprise ethanol. In another aspect, the blended gasoline composition is substantially free of ethanol. In one aspect, the blended gasoline composition does not comprise methanol. In another aspect, the blended gasoline composition is substantially free of methanol. In one aspect, the blended gasoline composition does not comprise ethanol and methanol. In another aspect, the blended gasoline composition is substantially free of ethanol and methanol. In a further aspect, the blended gasoline composition does not comprise methanol, isopropyl alcohol, n-butanol, t-butanol, methyl tert-butyl ether, tertiary amyl methyl ether, tertiary hexyl methyl ether, ethyl tertiary butyl ether, tertiary amyl ethyl ether, or diisopropyl ether, or a combination thereof. In an even further aspect, the blended gasoline composition is substantially free of methanol, isopropyl alcohol, n-butanol, t-butanol, methyl tert-butyl ether, tertiary amyl methyl ether, tertiary hexyl methyl ether, ethyl tertiary butyl ether, tertiary amyl ethyl ether, or diisopropyl ether, or a combination thereof.

In yet further aspects, the blended gasoline composition comprises an oxygen content in an amount that ranges from 0% by weight to 5.0% by weight, based on the total weight of the blended gasoline composition and the total oxygen content weight of all oxygenates present in the blended gasoline composition, including exemplary values of 0.01% by weight, 0.02% by weight, 0.03% by weight, 0.04% by weight, 0.05% by weight, 0.06% by weight, 0.1% by weight, 0.5% by weight, 1% by weight, 1.5% by weight, 2% by weight, 2.5% by weight, 3% by weight, 3.5% by weight, 4% by weight, and 4.5% by weight. In still further aspects, the blended gasoline composition can comprise an oxygen content in a range derived from any two of the above listed exemplary oxygen content weight percentage values. For example, the blended gasoline composition can comprise an oxygen content in an amount that ranges from 0% by weight to 0.06% by weight, based on the total weight of the blended gasoline composition and the total oxygen content weight of all oxygenates present in the blended gasoline composition. In another aspect, the blended gasoline composition can comprise an oxygen content in an amount that ranges from 0.01% by weight to 0.06% by weight, based on the total weight of the blended gasoline composition and the total oxygen content weight of all oxygenates present in the blended gasoline composition. In a further aspect, the blended gasoline composition can comprise an oxygen content in an amount that ranges from 0.02% by weight to 0.06% by weight, based on the total weight of the blended gasoline composition and the total oxygen content weight of all oxygenates present in the blended gasoline composition.

In one aspect, an oxygenate can be added, while the blended fuel composition comprises no ethanol or methanol or only a limited amount of ethanol or methanol. In another aspect, the blended fuel composition comprises an ether and comprises no ethanol or methanol or only a limited amount of ethanol or methanol. In a further aspect, the blended fuel composition comprises ethyl tert-butyl ether (ETBE) and comprises no ethanol or methanol or only a limited amount of ethanol or methanol. In a yet further aspect, the blended fuel composition oxygen content consists essentially of ETBE.

In one aspect, the lack of ethanol or methanol assists in restricting the water content of the blended gasoline composition. In another aspect, commercial ethanol and/or commercial methanol also contain water. This water can damage the engine and decrease performance. Thus, one benefit of the invention can be the elimination or minimization of ethanol and/or methanol, and the related elimination or minimization of water, leading to improved engine performance, reduced engine maintenance, and reduced costs from engine corrosion.

In one aspect, when the blended fuel composition comprises no ethanol or methanol or only a limited amount of ethanol or methanol, the blended composition can comprises an oxygen content, not contributed by ethanol or methanol, in an amount that ranges from 0% by weight to 20% by weight, based on the total weight of the blended gasoline composition and the total oxygen content weight of all oxygenates present in the blended gasoline composition, not including ethanol or methanol oxygen content, including exemplary values of 0.5% by weight, 1% by weight, 2, % by weight, 3% by weight, 4% by weight, 5% by weight, 6% by weight, 7% by weight, 8% by weight, 9% by weight, 10% by weight, 11% by weight, 12% by weight, 13% by weight, 14% by weight, 15% by weight, 16% by weight, 17% by weight, 18% by weight, and 19% by weight. In still further aspects, the blended gasoline composition can comprise a weight percentage in a range derived from any two of the above listed exemplary weight percentage ranges. For example, the blended gasoline composition can comprise an oxygen content, not contributed by ethanol or methanol, in an amount that ranges from 10% by weight to 15% by weight, based on the total weight of the blended gasoline composition and the total oxygen content weight of all oxygenates present in the blended gasoline composition, not including ethanol or methanol oxygen content. Further for example, the blended gasoline composition can comprises an oxygen content, not contributed by ethanol or methanol, in an amount that ranges from 1% by weight to 15% by weight, based on the total weight of the blended gasoline composition and the total oxygen content weight of all oxygenates present in the blended gasoline composition, not including ethanol or methanol oxygen content. In one aspect, the oxygen content comprises ETBE.

In yet further aspects, the blended gasoline composition comprises an oxygen content, contributed by ethanol, in an amount that ranges from 0% by weight to 0.75% by weight, based on the total weight of the blended gasoline composition and the total oxygen content weight of ethanol present in the blended gasoline composition, including exemplary values of 0.01% by weight, 0.02% by weight, 0.03% by weight, 0.04% by weight, 0.05% by weight, 0.06% by weight, 0.1% by weight, 0.15% by weight, 0.2% by weight, 0.25% by weight, 0.3% by weight, 0.35% by weight, 0.4% by weight, 0.45% by weight, 0.5% by weight, 0.55% by weight, 0.6% by weight, 0.65% by weight, and 0.7% by weight. In still further aspects, the blended gasoline composition can comprise an oxygen content, contributed by ethanol, in an amount in a range derived from any two of the above listed exemplary oxygen content weight percentage values. For example, the blended gasoline composition can comprise an oxygen content, contributed by ethanol, in an amount that ranges from 0% to 0.5% by weight, based on the total weight of the blended gasoline composition and the total oxygen content weight of ethanol present in the blended gasoline composition. When the blended gasoline composition comprises ethanol oxygen content in an amount that ranges from 0% by weight to 0.75% by weight, the composition is defined as not comprising ethanol or as substantially free of ethanol.

In yet further aspects, the blended gasoline composition comprises an oxygen content, contributed by methanol, in an amount that ranges from 0% by weight to 0.1% by weight, based on the total weight of the blended gasoline composition and the total oxygen content weight in the blended gasoline composition, including exemplary values of 0.01% by weight, 0.02% by weight, 0.03% by weight, 0.04% by weight, 0.05% by weight, 0.06% by weight, 0.07% by weight, 0.08% by weight, and 0.09% by weight. In still further aspects, the blended gasoline composition can comprise an oxygen content, contributed by methanol, in an amount in a range derived from any two of the above listed exemplary oxygen content weight percentage values. For example, the blended gasoline composition can comprise an oxygen content, contributed by methanol, in an amount that ranges from 0% by weight to 0.07% by weight. When the blended gasoline composition comprises methanol oxygen content in an amount that ranges from 0% by weight to 0.1% by weight, the composition is defined as not comprising methanol or as substantially free of methanol.

The composition's oxygen content is typically measured using ASTM D-4815.

5. Lead

Lead, as used herein, comprises any compound that comprises the element lead. In one aspect, the lead comprises elemental lead or a lead derivative. In a further aspect, the lead derivative comprises tetraethyllead. In a yet further aspect, the lead comprises any lead compound added to an automotive gasoline.

In yet further aspects, the blended gasoline composition comprises lead in an amount that ranges from 0 to 0.05 grams per gallon, including exemplary values of 0, 0.005 grams per gallon, 0.01 grams per gallon, 0.015 grams per gallon, 0.02 grams per gallon, 0.025 grams per gallon, 0.03 grams per gallon, 0.035 grams per gallon, 0.04 grams per gallon, or 0.045 grams per gallon. The "per gallon" is per gallon of the blended gasoline composition. In still further aspects, the blended gasoline composition can comprise lead in a range derived from any two of the above listed exemplary lead gram per gallon values. For example, the blended gasoline composition can comprise lead in an amount that ranges from 0 to 0.025 grams per gallon. In another aspect, the blended gasoline composition can comprise lead in an amount that ranges from 0 to 0.03 grams per gallon. In a yet further aspect, the blended gasoline composition can comprise lead in an amount that ranges from 0.025 to 0.035 grams per gallon. When the blended gasoline composition comprises lead in an amount that ranges from 0 grams per gallon to 0.05 grams per gallon, the composition is defined as unleaded.

In one aspect, the blended gasoline composition is considered an unleaded composition. In another aspect, the blended gasoline composition comprises an unleaded automotive gasoline.

The lead content in the blended gasoline composition is typically measured using ASTM D-3237. In this aspect, the lead content measures the total elemental lead content.

6. Aromatic Fraction

In one aspect, the blended gasoline composition comprises an aromatic fraction. In another aspect, the aromatic fraction comprises both an aromatic fraction from the automotive gasoline and an aromatic fraction from the octane enhancer. The aromatic fraction comprises any aromatic compounds in the blended gasoline composition.

In one aspect, the blended gasoline composition comprises an aromatic fraction in an amount that ranges from 30% by volume to 80% by volume, based on the total volume of the blended gasoline composition, including exemplary values of 35% by volume, 40% by volume, 45% by volume, 50% by volume, 55% by volume, 60% by volume, 65% by volume, 70% by volume, and 75% by volume. In still further aspects, the blended gasoline composition can comprise an aromatic fraction in a range derived from any two of the above listed exemplary aromatic fraction percent by volume values. For example, the blended gasoline composition can comprise an aromatic fraction in an amount that ranges from 35% by volume to 50% by volume, based on the total volume of the blended gasoline composition. In another aspect, the blended gasoline composition can comprise an aromatic fraction in an amount that ranges from 30% by volume to 70% by volume, based on the total volume of the blended gasoline composition. In a further aspect, the blended gasoline composition can comprise an aromatic fraction in an amount that ranges from 40% by volume to 50% by volume, based on the total volume of the blended gasoline composition. In an even further aspect, the blended gasoline composition can comprise an aromatic fraction in an amount that ranges from 36% by volume to 80% by volume, based on the total volume of the blended gasoline composition. In a yet further aspect, the blended gasoline composition can comprise an aromatic fraction in an amount that ranges from 38% by volume to 80% by volume, based on the total volume of the blended gasoline composition.

7. Blended Composition Characteristics

In accordance with the invention, the blended gasoline composition ("composition") has various characteristics to enable the composition to be a fuel suitable for use in an aircraft that is powered by a piston-driven engine.

Typically, aviation gasolines are defined by their adherence to the requirements of the ASTM D910, ASTM D7547, or ASTM D6227 specifications. However, in 1982, the FAA approved the use of automotive gasoline that contains no ethanol, that meets the requirements of the ASTM D4814 specification, and that is accompanied by an applicable Supplemental Type Certificate (STC) for use in applicable aircraft. Further, many aircraft airframe and engine manufactures now allow for the use of Automotive Gasoline within a given aircraft or engine by Type Certification (TC). Regardless, even if the automotive gasoline meets the requirements of the ASTM D4814 specification and does not contain ethanol, the automotive gasoline is not, by definition, an aviation gasoline, and may not necessarily be suitable for use in aircraft. The compositions of the invention herein meet the FAA requirements as provided by an applicable STC or by aircraft airframe and engine manufacturer by means of an applicable TC, and the compositions of the invention herein are suitable for use as an aviation gasoline while, technically, not defined as such.

In one aspect, the composition meets the requirements of the ASTM D4814 specification. Among other characteristics, ASTM D4814 specification controls the volatility of gasoline by setting limits for vapor pressure, distillation temperature at 10 percent, 50 percent, and 90 percent evaporation points and end points, drivability index, and vapor-liquid ratio properties. The specification employs six vapor pressure/distillation classes and six vapor-liquid ratio classes. In one aspect, the composition meets the distillation profile required by the ASTM D4814 specification. In another aspect, the composition meets the vapor pressure/distillation class A (ASTM D4814, Table 1). In a further aspect, the composition meets the vapor lock protection class 4 (ASTM D4814, Table 3).

In one aspect, the composition does not comply with a state law for on-road use within one or more specific geographical areas. In a further aspect, the state law is California or Arizona. In another aspect, the composition does not comply with a state law for on-road use because the composition does not comprise a sufficient amount of oxygen content for road use. For example, in some parts of California during certain times of the year, there is a minimum oxygen content requirement of 1.8% by weight for gasoline used on a road. In a further aspect, the composition does not comply with state law for on-road use by not complying with federal regulations for on-road use. In an even further aspect, the composition does not comply with federal regulations for on-road use by not comprising a sufficient amount of ethanol. For example, the Federal Energy Act for 2008 required a national average ethanol content of 7.76% by volume for on-road use.

The composition exhibits a distillation curve, which measures the tendency of a fuel to vaporize. This property is characterized by determining a series of temperatures at which various percentages of the fuel have evaporated, as described in ASTM D 86, Test Method for Distillation of Petroleum Products at Atmospheric Pressure, which is incorporated by reference for its description of the ASTM D 86 measurement method. The distillation curve temperature can be measured at 10% distilled (T10), at 50% distilled (T50), or at 90% distilled (T90).

In one aspect, the composition exhibits a distillation curve temperature at 10% distilled (T10) that ranges from 100° F. to 158° F., including, for example, about 110° F., 120° F., 130° F., 140° F., or 150° F. In still further aspects, the distillation curve temperature at 10% distilled (T10) can be present in any range of amounts derived from the above temperatures. For example, the distillation curve temperature at 10% distilled (T10) can range from 140° F. to 150° F.

In one aspect, the composition exhibits a distillation curve temperature at 50% distilled (T50) that ranges from 170° F. to 250° F., including, for example, about 180° F., 190° F., 200° F., 210° F., 220° F., 230° F., or 240° F. In still further aspects, the distillation curve temperature at 50% distilled (T50) can be present in any range of amounts derived from the above temperatures. For example, the distillation curve temperature at 50% distilled (T50) can range from 200° F. to 240° F.

In one aspect, the composition exhibits a maximum distillation curve temperature at 90% distilled (T90) of 347° F.

In one aspect, the composition exhibits a distillation curve temperature at 90% distilled (T90) that ranges from 260° F. to 437° F., including, for example, about 270° F., 280° F., 290° F., 300° F., 310° F., 320° F., 330° F., 340° F., 350° F., 360° F., 370° F., 380° F., 390° F., 400° F., 410° F., 420° F., and 430° F. In still further aspects, the distillation curve temperature at 90% distilled (T90) can be present in any range of amounts derived from the above temperatures. For example, the distillation curve temperature at 90% distilled (T90) can range from 360° F. to 380° F.

In one aspect, the composition comprises a pressurant in an amount to modify the Dry Vapor Pressure Equivalent (DVPE) to the desired level. The DVPE, in addition to distillation profile, is a physical property used to characterize the fuel's volatility, and its ability to vaporize. Generally speaking a more volatile fuel has a higher DVPE and distills at a lower temperature. In one aspect, monitoring and adjusting the DVPE of the composition to a low and year-round value renders the composition suitable for use in an aircraft on a year-round basis. This is in contrast to readily available automotive gasoline, where, depending upon seasonal and geographic locations, DVPE of gasoline available to consumers may vary greatly, from region to region, and season to season. This inconsistency of DVPE, in addition to other volatility characteristics, renders these automotive gasolines unsuitable for use in aircraft.

In one aspect, the composition has a year-round DVPE less than 9.0 psi. In another aspect, the composition has a year-round DVPE exhibited in a range from 7.0 psi to 9.0 psi, including exemplary values, 7.3 psi, 7.5 psi, 7.7 psi, 8.0 psi, 8.3 psi, 8.5 psi, 8.6 psi, 8.7 psi, 8.8 psi, and 8.9 psi. In still further aspects, the composition can exhibit a year-round DVPE in any range of values derived from the above DVPE values. For example, the DVPE can range from 7.0 psi to 8.9 psi or from 7.5 psi to 8.0 psi.

In one aspect, the composition exhibits a minimum antiknock index (AKI) value of 93.0 for improved engine knock resistance, as a knock-free engine performance is essential for smooth and reliable engine performance in an aircraft. Two laboratory test methods are utilized towards generating the AKI value of the composition. One test yields the Research Octane Number (RON); the other test yields the Motor Octane Number (MON). RON correlates best with low speed, mild knocking conditions; MON, correlates best with high speed and high temperature knocking conditions and with part throttle operation. For a given gasoline, RON is always higher than MON, and the difference between the two values is called the sensitivity of the gasoline. The AKI value is calculated by averaging the RON and MON values, represented by the following equation: (R+M/2).

In one aspect, one benefit of the invention composition is a higher AKI value when compared to an automotive gasoline. The higher AKI value can result in better engine performance.

In a further aspect, the AKI is measured using ASTM methods D-2699 (to measure the RON) and D-2700 (to measure the MON), which are both used to calculate the AKI.

In one aspect, the composition has an antiknock index (AKI) exhibited in a range from 82 to 100, including exemplary values, 83, 84, 85, 86, 87, 88, 89, 90, 91, 92, 93, 94, 95, 96, 97, 98, and 99. In still further aspects, the composition can exhibit an AKI in any range of values derived from the above AKI values. For example, the AKI can range from 88 to 100, the AKI can range from 91 to 100, or the AKI can range from 93 to 100. In a still further aspect, the composition can exhibit an AKI greater than or equal to 93.

In one aspect, the composition can comprise an aromatic fraction of 60% by volume and sulfur at 30 ppm. This composition can have a DVPE ranging from 7.0 psi to 9.0 psi, Vapor/Liquid ratio=20 at 116° F. (min), T(10) of 158° F. (max), T(50) of 170° F. to 250° F., T(90) of 374° F. (max), and a minimum Research Octane Number (RON)+Motor Octane Number (MON)/2 (AKI) of 93.0.

C. Aircraft Uses

In one aspect, the utility of the composition described herein is as a composition suitable for use in an aircraft that is powered by a piston-driven engine.

In specific aspects, the aircraft that is powered by a piston-driven engine comprises an aircraft that is powered by a propeller-driven engine. In further aspects, the aircraft that is powered by a piston-driven engine is light sport aircraft, single engine aircraft, twin engine aircraft, or four engine aircraft. In specific aspects, the aircraft is B-17, B-24, B-25, C-47, P-51, P-40, P-47, P-38, or DC-3. In a further aspect, the aircraft can be powered by a Lycoming® engine.

In the aircraft uses, any of the inventive compositions or methods recited herein throughout this specification can be employed.

D. Methods of Making the Compositions

Also disclosed herein are methods of making a composition useful as a gasoline composition.

In one aspect, a method for preparing a blended gasoline composition comprises:

a) providing an automotive gasoline without an oxygenate or before an oxygenate has been added; and b) blending the automotive gasoline with an octane enhancer and with a pressurant, thereby making the blended gasoline composition;

wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition;

wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended gasoline composition.

In the methods of making the compositions, any of the inventive compositions recited herein throughout this specification can be employed.

In one aspect, the blended gasoline composition comprises an oxygen content in an amount that ranges from 0% by weight to 5.0% by weight, based on the total weight of the blended gasoline composition and the total oxygen content weight of all oxygenates present in the blended gasoline composition.

In one aspect, the automotive gasoline can be provided without an oxygenate or can be before the oxygenate has been added. In one aspect, the automotive gasoline of method step (a) above is obtained commercially from a refinery before the oxygenate has been added. In another aspect, with this method, an oxygenate is not added and is, therefore, minimized. In one aspect, the automotive gasoline of step (a) is obtained commercially from a refinery after the addition of an oxygenate, but before the addition of ethanol and/or methanol. In a further aspect, the automotive gasoline of step (a) is obtained commercially from a refinery after the addition of ETBE, but before the addition of ethanol and/or methanol.

Typically, the automotive gasoline and octane enhancer are mixed first and then the pressurant is added. In this aspect, the automotive gasoline or the octane enhancer can be mixed or blended in either order. Such blending can be by any typical blending technique in the art, such as utilizing a tank and/or a mixer. After the automotive gasoline and the octane enhancer have been blended, the pressurant can be added. In one aspect, the pressurant can be added under pressure in the liquid phase. In various aspects, the pressurant is added by injection and is mixed by using a tank and/or mixer and/or a static mixer.

In one aspect, the pressurant can be added under pressure. The pressurant pressure can range from 60 psi to 100 psi, including exemplary values of 65 psi, 70 psi, 75 psi, 80 psi, 85 psi, 90 psi, and 95 psi. In still further aspects, the pressure range can be derived from any of the above pressures. For example, the pressurant pressure can range from 70 psi to 80 psi.

E. Methods of Using the Compositions

Hence, the disclosed compositions can be used as a fuel in an aircraft that is powered by a piston-driven engine. In one aspect, disclosed herein is a method for using the blended gasoline composition of the invention comprising combusting the disclosed blended gasoline composition in a piston-driven engine that is used to power an aircraft.

In the methods of using, any of the inventive compositions or methods recited herein throughout this specification can be employed.

F. Aspects

The disclosed methods and compositions include at least the following aspects.

Aspect 1: A method for preparing a blended gasoline composition comprising:

a) providing an automotive gasoline; and b) blending the automotive gasoline with an octane enhancer and with a pressurant, thereby making the blended gasoline composition;

wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition;

wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended gasoline composition.

Aspect 2: The method according to aspect 1, wherein the blended gasoline composition comprises an oxygen content in an amount that ranges from 0% by weight to 5.0% by weight, based on the total weight of the blended gasoline composition and the total oxygen content weight of all oxygenates present in the blended gasoline composition.

Aspect 3: The method according to any of aspects 1-2, wherein the blended gasoline composition is suitable for use in an aircraft that is powered by a piston-driven engine.

Aspect 4: The method according to any of aspects 1-3, wherein the automotive gasoline of step (a) is obtained commercially from a refinery before the oxygenate has been added.

Aspect 5: The method according to any of aspects 1-4, wherein the blended gasoline composition does not comply with a state law for on-road use.

Aspect 6: The method according to any of aspects 1-5, wherein the octane enhancer comprises toluene.

Aspect 7: The method according to any of aspects 1-6, wherein the pressurant comprises n-butane.

Aspect 8: The method according to any of aspects 1-7, wherein the blended gasoline composition comprises an aromatic fraction in an amount that ranges from 30% by volume to 80% by volume, based on the total volume of the blended gasoline composition.

Aspect 9: The method according to any of aspects 1-8, wherein the blended gasoline composition comprises an aromatic fraction comprising both an aromatic fraction from the automotive gasoline and an aromatic fraction from the octane enhancer.

Aspect 10: The method according to any of aspects 1-9, wherein the automotive gasoline comprises:

a) meeting the requirements of ASTM D4814, or is intended to meet the requirements of the ASTM D4814 Specification after the addition of an oxygenate;
b) having an anti-knock index value (R+M/2) greater than or equal to 84; and
c) having a dry vapor pressure equivalent (DVPE) less than or equal to 11.0 pounds per square inch (psi).

Aspect 11: The method according to any of aspects 1-10, wherein the automotive gasoline comprises:

a) meeting the requirements of ASTM D4814, or is intended to meet the requirements of the ASTM D4814 Specification after the addition of an oxygenate;
b) having an anti-knock index value (R+M/2) that ranges from 84 to 92; and
c) having a dry vapor pressure equivalent (DVPE) that ranges from 5.5 pounds per square inch (psi) to 11.0 pounds per square inch (psi).

Aspect 12: The method according to any of aspects 1-11, wherein the blended gasoline composition meets the requirements of the ASTM D4814 Specification.

Aspect 13: The method according to any of aspects 1-12, wherein the automotive gasoline comprises a federal reformulated gasoline (RFG), a premium sub-grade blendstock for oxygenate blending (BOB), a premium sub-grade Arizona reformulated blendstock for oxygenate blending (AZRBOB), a full octane Arizona Cleaner Burning Gasoline, a premium sub-grade California reformulated blendstock for oxygenate blending (CARBOB), or a full octane California Air Resources Board (CARB).

Aspect 14: The method according to any of aspects 1-13, wherein the automotive gasoline comprises a cleaner burning gasoline or a conventional gasoline.

Aspect 15: The method according to any of aspects 1-14, wherein the automotive gasoline comprises a blendstock for oxygenate blending (BOB).

Aspect 16: The method according to aspects 1-15, wherein the blended gasoline composition comprises:

a) an automotive gasoline in an amount that ranges from 40% by volume to 97% by volume, based on the total volume of the blended gasoline composition;
b) an octane enhancer in an amount that ranges from 2% by volume to 59% by volume, based on the total volume of the blended gasoline composition; and
c) a pressurant in an amount that ranges from 1% by volume to 10% by volume, based on the total volume of the blended gasoline composition.

Aspect 17: A blended gasoline composition comprising:

a) an automotive gasoline in an amount that ranges from 40% by volume to 97% by volume, based on the total volume of the blended gasoline composition;
b) an octane enhancer in an amount that ranges from 2% by volume to 59% by volume, based on the total volume of the blended gasoline composition; and
c) a pressurant in an amount that ranges from 1% by volume to 10% by volume, based on the total volume of the blended gasoline composition;

wherein the blended gasoline composition comprises an oxygen content, contributed by ethanol, in an amount that ranges from 0% by weight to 0.75% by weight, based on the total weight of the blended gasoline composition and the total oxygen content weight contribution of ethanol present in the blended gasoline composition;

wherein the blended gasoline composition comprises an oxygen content, contributed by methanol, in an amount that ranges from 0% by weight to 0.1% by weight, based on the total weight of the blended gasoline composition and the total oxygen content weight contribution of methanol present in the blended gasoline composition; and wherein the blended gasoline composition comprises lead in an amount that ranges from 0 grams per gallon to 0.05 grams per gallon of the blended fuel composition.

Aspect 18: The blended gasoline composition according to any of aspect 17, wherein the blended gasoline composition comprises an oxygen content in an amount that ranges from 0% by weight to 5.0% by weight, based on the total weight of the blended gasoline composition and the total oxygen content weight of all oxygenates present in the blended gasoline composition.

Aspect 19: The blended gasoline composition according to any of aspects 17-18, wherein the blended gasoline composition is suitable for use in an aircraft that is powered by a piston-driven engine.

Aspect 20: A method for using a blended gasoline composition in an engine aircraft comprising combusting the blended gasoline composition of aspect 17 in an aircraft that is powered by a piston-driven engine.

Aspect 21: The blended gasoline composition according to any of aspects 17-19, wherein the blended gasoline composition does not comply with a state law for on-road use.

Aspect 22: The blended gasoline composition according to any of aspects 17-19 and 21, wherein the octane enhancer comprises toluene.

Aspect 23: The blended gasoline composition according to any of aspects 17-19 and 21-22, wherein the pressurant comprises n-butane.

Aspect 24: The blended gasoline composition according to any of aspects 17-19 and 21-23, wherein the blended gasoline composition comprises an aromatic fraction in an amount that ranges from 30% by volume to 80% by volume, based on the total volume of the blended gasoline composition.

Aspect 25: The blended gasoline composition according to any of aspects 17-19 and 21-24, wherein the blended gasoline composition comprises an aromatic fraction comprising both an aromatic fraction from the automotive gasoline and an aromatic fraction from the octane enhancer.

Aspect 26: The blended gasoline composition according to any of aspects 17-19 and 21-25, wherein the automotive gasoline comprises:

a) meeting the requirements of ASTM D4814, or is intended to meet the requirements of the ASTM D4814 Specification after the addition of an oxygenate;
b) having an anti-knock index value (R+M/2) greater than or equal to 84; and
c) having a dry vapor pressure equivalent (DVPE) less than or equal to 11.0 pounds per square inch (psi).

Aspect 27: The blended gasoline composition according to any of aspects 17-19 and 21-26, wherein the automotive gasoline comprises:

a) meeting the requirements of ASTM D4814, or is intended to meet the requirements of the ASTM D4814 Specification after the addition of an oxygenate
b) having an anti-knock index value (R+M/2) that ranges from 84 to 92; and
c) having a dry vapor pressure equivalent (DVPE) that ranges from 5.5 pounds per square inch (psi) to 11.0 pounds per square inch (psi).

Aspect 28: The blended gasoline composition according to any of aspects 17-19 and 21-27, wherein the blended gasoline composition meets the requirements of the ASTM D4814 Specification.

Aspect 29: The blended gasoline composition according to any of aspects 17-19 and 21-28, wherein the automotive gasoline comprises a federal reformulated gasoline (RFG), a premium sub-grade blendstock for oxygenate blending (BOB), a premium sub-grade Arizona reformulated blendstock for oxygenate blending (AZRBOB), a full octane Arizona Cleaner Burning Gasoline, a premium sub-grade California reformulated blendstock for oxygenate blending (CARBOB), or a full octane California Air Resources Board (CARB).

Aspect 30: The blended gasoline composition according to any of aspects 17-19 and 21-29, wherein the automotive gasoline comprises a cleaner burning gasoline or a conventional gasoline.

Aspect 31: The blended gasoline composition according to any of aspects 17-19 and 21-30, wherein the automotive gasoline comprises a blendstock for oxygenate blending (BOB).

G. Experimental

The following examples are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Several methods for preparing the compositions of this invention are illustrated in the following Examples. Starting materials and the requisite intermediates are in some cases commercially available, or can be prepared according to literature procedures or as illustrated herein.

The following exemplary compositions of the invention were synthesized. The Examples are provided herein to illustrate the invention, and should not be construed as limiting the invention in any way.

Example 1

Method of making gasoline for use in an aircraft that is powered by a piston-driven engine:

Composition A was prepared by blending the following components, at the stated percentages:

Premium AZRBOB at 62.0 volume %; and,

Toluene at 38.0 volume %

After adequate blending of these two components, at the stated percentages by volume, a sample of the solution was drawn and tested for AKI (R+M/2) and Dry Vapor Pressure Equivalent (DVPE) in order to validate that the AKI (R+M/2) value of the solution exceeded 93.0, and that the solution's DVPE did not exceed 9.0 psi.

After validation of those characteristics of the solution, as stated above, N-Butane, in the liquid phase, was blended into that solution, in the amount of 6.0 volume %, which resulted in the formulation of the finished product, with an estimated AKI (R+M/2) value of >93.0 and an estimated DVPE<9.0.

After completing the above-mentioned procedure, a one-gallon sample of the finished product was tested for ASTM D4814 (Standard Specification for Automotive Spark-Ignition Engine Fuel) analysis, for the purpose of certifying that the finished product met all applicable requirements of the ASTM D4814 specification. The results of those tests are set forth in Table 1 below.

TABLE 1

ASTM D4814: Results of Analysis of Composition A

| Method | Test | Unit | Result |
|---|---|---|---|
| ASTM D2699 | Research Octane Number | — | 99.3 |
| ASTM D2700 | Motor Octane Number | — | 88.1 |
| ASTM D4814 | Antiknock Index (R + M/2) | — | 93.7 |
| ASTM D5191 | Dry Vapor Pressure Equivalent | psi | 8.41 |
| | Hazy | — | No |
| | Volume Container Size | L | 1 |
| ASTM D86 | Distillation | Degrees F. | |
| | Initial Boiling Point | Degrees F. | 87.6 |
| | 5% Evaporated | Degrees F. | 118.6 |

TABLE 1-continued

ASTM D4814: Results of Analysis of Composition A

| Method | Test | Unit | Result |
|---|---|---|---|
| | 10% Evaporated | Degrees F. | 143.0 |
| | 20% Evaporated | Degrees F. | 183.5 |
| | 30% evaporated | Degrees F. | 206.2 |
| ASTM D86 | 40% Evaporated | Degrees F. | 215.7 |
| | 50% Evaporated | Degrees F. | 221.5 |
| | 60% Evaporated | Degrees F. | 226.5 |
| | 70% Evaporated | Degrees F. | 232.1 |
| | 80% Evaporated | Degrees F. | 239.9 |
| | 90% Evaporated | Degrees F. | 263.6 |
| | 95% Evaporated | Degrees F. | 311.5 |
| | Endpoint | Degrees F. | 362.4 |
| | Recovery | % | 96.7 |
| | Residue | % | 1.0 |
| | Loss | % | 2.3 |
| | Evaporated at 200 | % | 26.2 |
| | Evaporated at 300 | % | 94.1 |
| IP 559 | API Gravity @ 60 F. | — | 51.6 |
| ASTM D3237 | Lead | ppm/g/Gal | <2.5/<0.0010 |
| ASTM D130 | Copper Corrosion (at 50 C. for 3 hr) | — | 1a |
| ASTM D381 | Unwashed Gum | mg/100 mL | 2.0 |
| | Washed Gum | mg/100 mL | 0.5 |
| | Filtered | — | No |
| ASTM D525 | Induction Period (at 100 C.) | Min | >300 |
| ASTM D5453 | Sulfur Content | ppm/wt % | 9.5/0.0010 |
| ASTM D4815 | Methanol | Vol %/mass % Oxygen | ND |
| | Ethanol | Vol %/mass % Oxygen | ND |
| | TBA | Vol %/mass % Oxygen | ND |
| | Ethyl tert-Butyl Ether | Vol %/mass % Oxygen | ND |
| | Methyl tert-Butyl Ether | Vol %/mass % Oxygen | ND |
| | Tertiary Amyl Methyl Ether | Vol %/mass % Oxygen | ND |
| | Total Oxygen | Mass % Oxygen | ND |
| ASTM D1319 | Aromatics | Volume % | 44.4 |
| | Olefins | Volume % | 3.5 |
| | Saturates | Volume % | 52.1 |
| ASTM D4814 | Drivability Index | — | 1143 |
| | Vapor/Liquid Ratio | Degrees F. | 146.4 |
| ASTM D3231 | Phosphorus | ppm/g/Gal | <0.2/<0.0008 |

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for preparing a piston-driven engine blended aviation gasoline composition comprising:

a. providing a blendstock for automotive gasoline, wherein the provided blendstock for automotive gasoline comprises an oxygen content in an amount that ranges from 0% by weight to 0.06% by weight, and a lead content in an amount that ranges from 0 grams per gallon to 0.03 grams per gallon; and then b. adding an octane enhancer and a pressurant to the provided blendstock for automotive gasoline, thereby making the piston-driven engine blended aviation gasoline composition, wherein the method does not comprise a step of adding an additional amount of oxygenate or lead to the provided blendstock for automotive gasoline and does not comprise a step of adding an additional amount of oxygenate or lead to the piston-driven engine blended aviation gasoline composition;

wherein the piston-driven engine blended aviation gasoline composition comprises an oxygen content, contributed by ethanol, in an amount that ranges from 0% by weight to 0.06% by weight, based on the total weight of the piston-driven engine blended aviation gasoline composition and the total oxygen content weight contribution of ethanol present in the piston-driven engine blended aviation gasoline composition;

wherein the piston-driven engine blended aviation gasoline composition comprises an oxygen content, contributed by methanol, in an amount that ranges from 0% by weight to 0.06% by weight, based on the total weight of the piston-driven engine blended aviation gasoline composition and the total oxygen content weight contribution of methanol present in the piston-driven engine blended aviation gasoline composition; and wherein the piston-driven engine blended aviation gasoline composition comprises lead in an amount that ranges from 0 grams per gallon to 0.03 grams per gallon of the piston-driven engine blended aviation gasoline composition; and wherein the piston-driven engine blended aviation gasoline composition comprises an oxygen content in an amount that ranges from 0% by weight to 0.06% by weight, based on the total weight of the piston-driven engine blended aviation gasoline composition and the total oxygen content weight of all oxygenates present in the piston-driven engine blended aviation gasoline composition.

2. The method according to claim 1, wherein the blendstock for automotive gasoline of step (a) is obtained commercially from a refinery before an oxygenate has been added in the refinery.

3. The method according to claim 1, wherein the piston-driven engine blended aviation gasoline composition does not comply with California state law for on-road use.

4. The method according to claim 1, wherein the octane enhancer comprises toluene.

5. The method according to claim 1, wherein the pressurant comprises n-butane.

6. The method according to claim 1, wherein the piston-driven engine blended aviation gasoline composition comprises an aromatic fraction in an amount that ranges from 40% by volume to 80% by volume, based on the total volume of the piston-driven engine blended aviation gasoline composition.

7. The method according to claim 1, wherein the piston-driven engine blended aviation gasoline composition comprises an aromatic fraction comprising both an aromatic fraction from the blendstock for automotive gasoline and an aromatic fraction from the octane enhancer.

8. The method according to claim 1, wherein the blendstock for automotive gasoline comprises:

a. meeting the requirements of ASTM D4814, or is intended to meet the requirements of the ASTM D4814 Specification after the addition of an oxygenate;

b. having an anti-knock index value (R+M/2) greater than or equal to 84; and c. having a dry vapor pressure equivalent (DVPE) less than or equal to 11.0 pounds per square inch.

9. The method according to claim 1, wherein the blendstock for automotive gasoline comprises:

a. meeting the requirements of ASTM D4814, or is intended to meet the requirements of the ASTM D4814 Specification after the addition of an oxygenate;

b. having an anti-knock index value (R+M/2) that ranges from 84 to 92; and c. having a dry vapor pressure equivalent (DVPE) that ranges from 7.0 pounds per square inch to 11.0 pounds per square inch.

10. The method according to claim 1, wherein the piston-driven engine blended aviation gasoline composition meets the requirements of the ASTM D4814 Specification.

11. The method according to claim 1, wherein the blendstock for automotive gasoline comprises a cleaner burning gasoline or a conventional gasoline.

12. The method according to claim 1, wherein the piston-driven engine blended aviation gasoline composition comprises:

a. a blendstock for automotive gasoline in an amount that ranges from 40% by volume to 97% by volume, based on the total volume of the piston-driven engine blended aviation gasoline composition;

b. an octane enhancer in an amount that ranges from 2% by volume to 59% by volume, based on the total volume of the piston-driven engine blended aviation gasoline composition; and c. a pressurant in an amount that ranges from 1% by volume to 10% by volume, based on the total volume of the piston-driven engine blended aviation gasoline composition.

13. The method of claim 1, wherein the provided blendstock for automotive gasoline comprises an oxygen content of 0% by weight.

* * * * *